US005697646A

United States Patent [19]

Venegas

[11] Patent Number: 5,697,646

[45] Date of Patent: Dec. 16, 1997

[54] DOCUMENT COVER WITH HIDDEN BINDING

[76] Inventor: Reynaldo A. Venegas, 2903 N. Harrison Ave., Orlando, Fla. 32804-4444

[21] Appl. No.: 517,554

[22] Filed: Aug. 21, 1995

[51] Int. Cl.[6] ..... B42F 13/00

[52] U.S. Cl. ..... 281/37; 402/76; 402/57

[58] Field of Search ..... 402/57, 70, 73, 402/76, 77, 80 R, 80 L, 74; 281/15.1, 19.2, 21.1, 27.1, 27, 36, 37, 29

[56] References Cited

U.S. PATENT DOCUMENTS 4,711,469 12/1987 Bogar ..... 281/25 A
4,907,905 3/1990 Fournier ..... 402/80 R
4,941,804 7/1990 Sarpy, Jr. ..... 412/7
5,417,510 5/1995 Stout ..... 402/76

*Primary Examiner*—Willmon Fridie, Jr.
*Attorney, Agent, or Firm*—John V. Stewart

[57] ABSTRACT

A document binder made from a single piece of cover material segmented by scores. The user folds the cover along the scores to front from and back panels hinged to a spine having an inward-folded tab. The tab is punched for page binding means such as a comb or spiral rings using conventional office equipment. The tab and binder rings are hidden from view when the cover is closed. In the preferred embodiment the spine is flat, allowing labelling thereon.

9 Claims, 5 Drawing Sheets

DOCUMENT COVER WITH HIDDEN BINDING

BACKGROUND

1. Field

This invention relates to methods and devices for binding documents, manuals, reports, presentation materials, and the like.

2. Prior Art

Prior document binding devices include staples, glued and/or stitched sheets, report covers, post binders, and ring binders. They all have disadvantages in appearance, cost, or convenience.

Permanent binding of pages in a cover with a flat spine, using glue and/or stitching, provides a finished, professional appearance. However, it is expensive in small quantities, the documents cannot be updated, and they will not lie flat when open.

Loose-leaf 3-ring binders offer flexibility for updating of documents, but are expensive, bulky, costly to customize the overall color or apply permanent printing, and tend to tear the page holes.

Report covers are available in various designs. They only hold a small number of sheets, do not have a flat spine, and do not have an ideal appearance.

Spiral and comb ring binders surpass report covers in appearance and capacity. They are practical in small quantities, are light, compact, inexpensive, and lie flat when open. They do not tend to tear the page holes. However, their appearance is still not ideal, since the rings are externally visible, and there is no flat spine for labelling. The present invention solves both of these disadvantages, and provides additional economy and convenience.

OBJECTS

The object of this invention is a document binder/cover with the following features:

A. A finished, professional appearance.

B. A flat spine on which printing can be applied.

C. The document lays flat in the opened position.

D. Can be manufactured, distributed, and sold as a single sheet of inexpensive scored cover material.

E. Easily folded and assembled by the end user, including punching and insertion of standard binder rings using existing office equipment.

F. Can be easily printed and embossed before folding.

G. An optional removable front cover can be fed into a standard office copy machine for convenient labelling by the user.

SUMMARY OF THE INVENTION

The invention described herein meets the above objects. It is a document binder made from a single sheet of cover material segmented by scores. The user folds the material along the scores to form front and back panels hinged to a spine having an inward-folded tab. The tab is punched for page binding means such as a comb or spiral rings, using conventional office equipment. The tab and page binding rings are hidden from view. In the preferred embodiment the spine is flat, allowing labelling thereon.

DRAWING FIGURES

Figure 1:
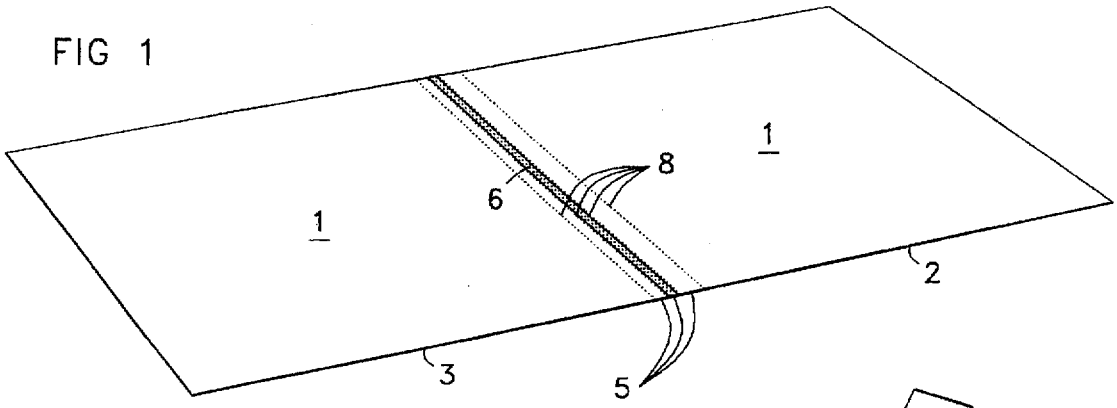

FIG. 1 Shows a sheet of cover material with scores and an adhesive strip.

Figure 2:
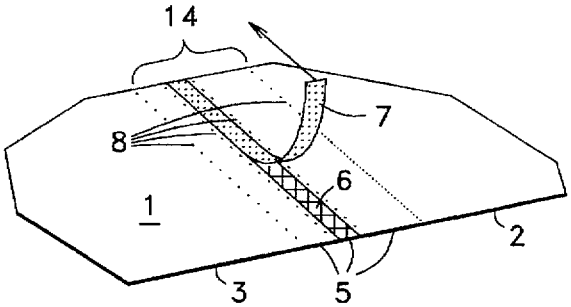

FIG. 2 An enlarged partial view of FIG. 1, showing removal of protective tape from the adhesive strip.

Figure 3:
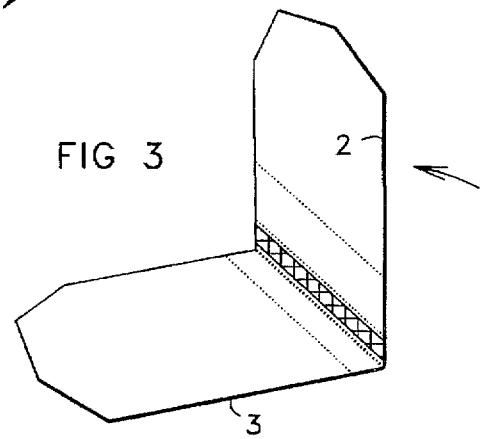

FIG. 3 The view of FIG. 2 showing the first fold in progress.

Figure 4:
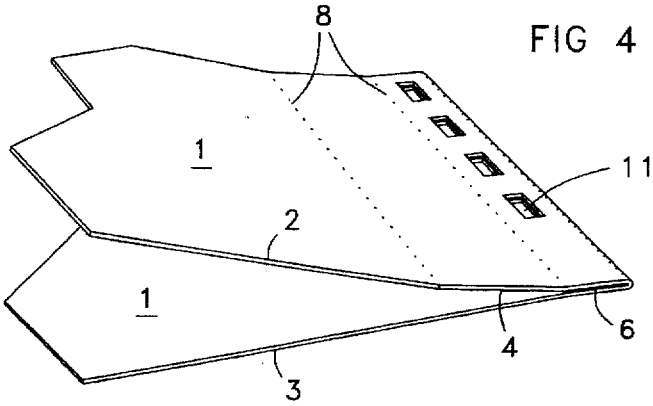

FIG. 4 The view of FIG. 3 with the first fold complete and holes punched.

Figure 5:
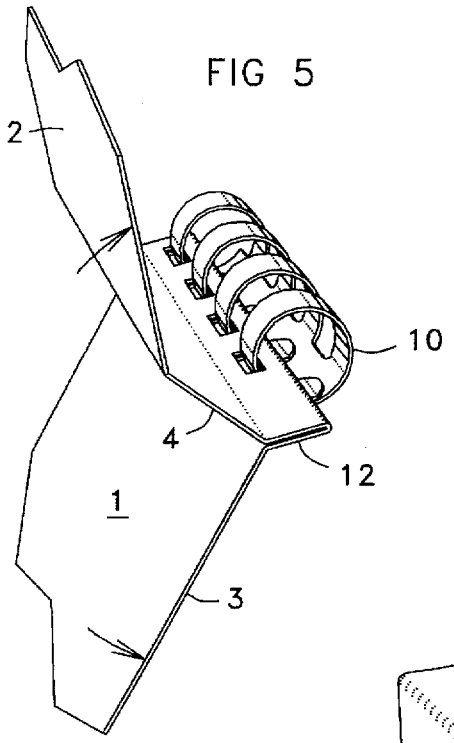

FIG. 5 The view of FIG. 4 with a comb installed and final folds in progress.

Figure 6:
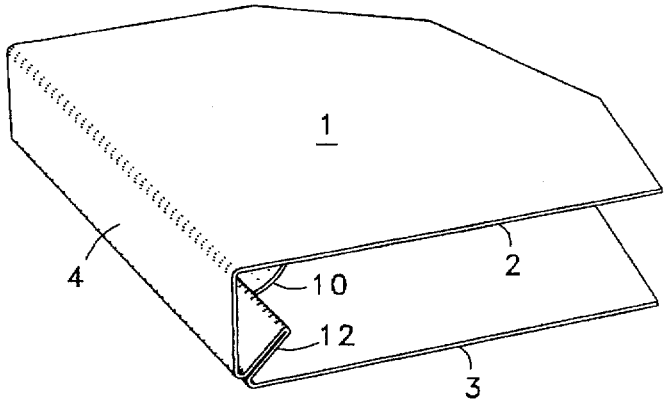

FIG. 6 The view of FIG. 5 with the folds complete.

Figure 7:
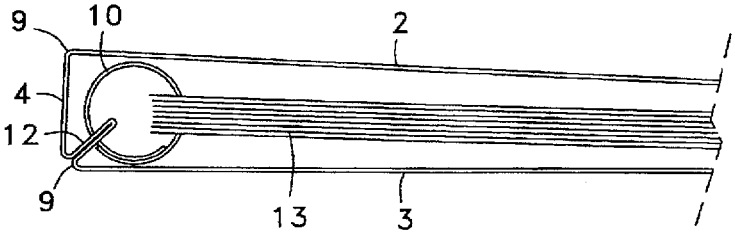

FIG. 7 Bottom view of FIG. 6.

Figure 8:
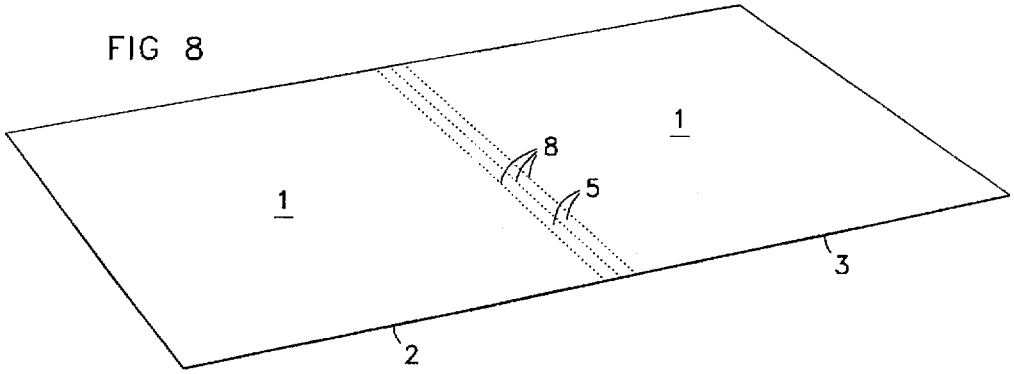

FIG. 8 Shows a sheet of cover material with scores for a second embodiment.

Figure 9:
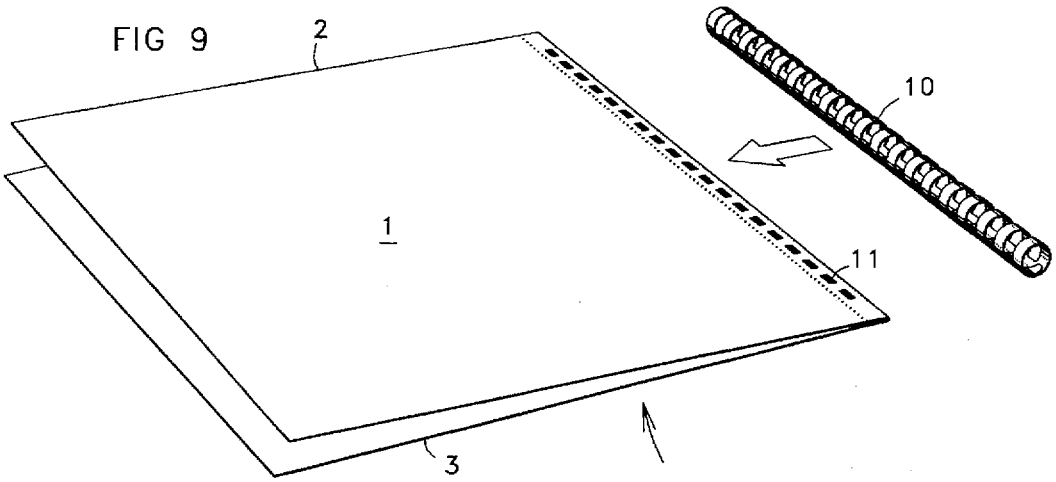

FIG. 9 The view of FIG. 8 after the first fold, with binder holes punched.

Figure 10:
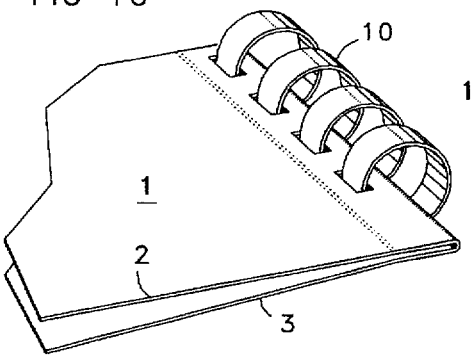

FIG. 10 An enlarged partial view of FIG. 9 with a binder comb installed.

Figure 11:
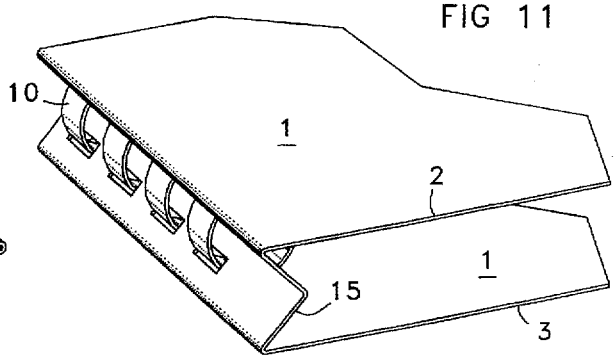

FIG. 11 The view of FIG. 10 after final folds.

Figure 12:
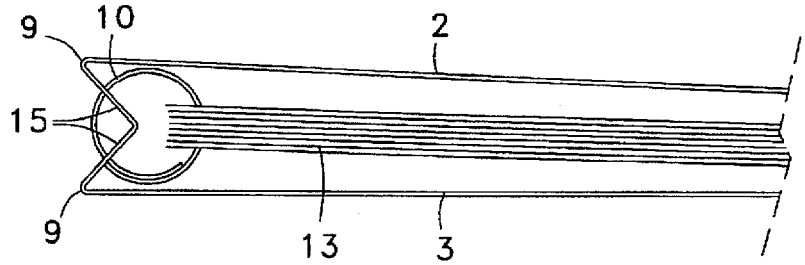

FIG. 12 Bottom view of FIG. 11.

Figure 13:
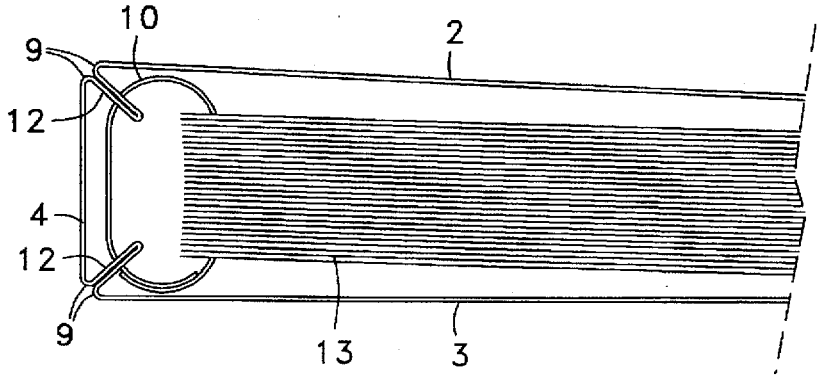

FIG. 13 Shows two tabs 12 used with a wide comb, for thick documents.

Figure 14:
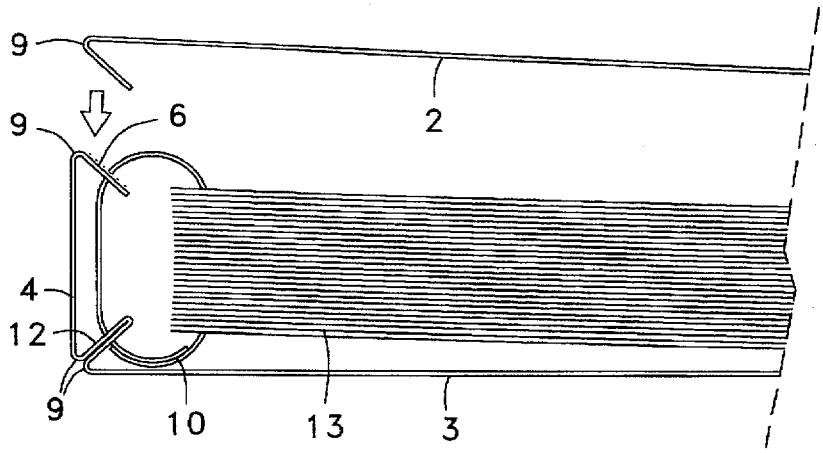

FIG. 14 The view of FIG. 13, with optional separate front panel.

Figure 15:
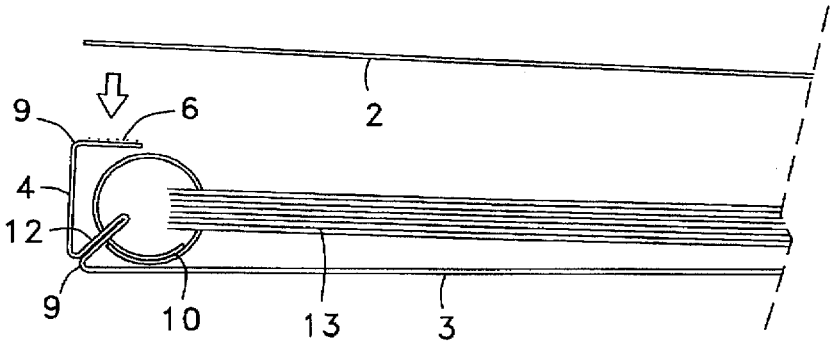

FIG. 15 The view of FIG. 6 with optional separate front panel.

Figure 16:
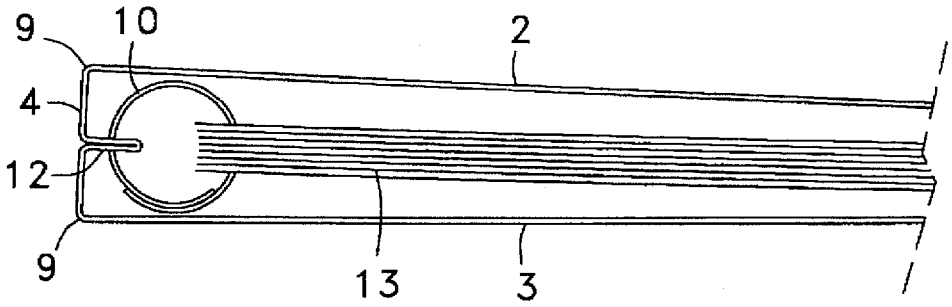

FIG. 16 Bottom view showing inward folded tab at mid spine.

REFERENCE NUMERALS

1 Cover material
2 Front panel
3 Back panel
4 Spine
5 Narrow panel
6 Adhesive
7 Removable protective tape
8 Score
9 Hinge
10 Comb
11 Punched holes
12 Inward folded tab
13 Pages of a document
14 Spine portion of the cover material, including narrow panels for tab
15 v-shaped spine/tab of second embodiment

TERMINOLOGY

Back view: The view facing the back panel from outside the closed cover.

Comb: A spaced series of interconnected coaxial binding rings.

Front view: The view facing the front panel from outside the closed cover.

Hinge: Means for pivoting two panels relative to each other along a common attached edge. A score becomes a hinge when folded. A hinge can be of the same or a different material than the cover material.

Inward: Towards the geometric center of the general U-shape of the closed binder.

Outer surface: The surface of the cover material which is outermost when the cover is folded.

Score: A depressed or thinned line of the cover material which acts as a hinge when the material is folded along the line.

Spiral binder: A helical wire of metal or plastic used for binding by threading the wire through a series of holes punched in an edge of a stack of pages.

Transfer tape: A two-sided adhesive strip with removable protective cover tape.

U-shaped: Approximate shape of closed binder cover viewed from the top or bottom, with from and back panels hinged to a spine. Includes W-shaped, in which the spine comprises an inwardly folded v-shaped tab.

DESCRIPTION

FIG. 1 shows a single sheet of cover material, scored for folding into a generally U-shaped cover, including front and back panels and a spine portion. When folded, the scores become hinges between adjacent panels. The spine portion is further segmented by scores into narrow panels 5. As shown in FIGS. 2–8, these are folded to create a flat, enclosed spine panel and an inwardly projecting tab. An adhesive strip 6 bonds two adjacent sub-panels of the spine portion together to form the tab. The adhesive may optionally be covered with protective tape to allow stacked packaging and distribution of the prepared cover material for later folding by a user. The cover material may be any flat light material, such as cover-weight paper, vinyl, or the like.

FIG. 4 shows holes punched in the folded tab. This can be done by the user with conventional office equipment for punching and applying comb type binding rings. Spiral binding rings or other page attachment means can likewise be used. Optionally, holes can be pre-punched by the manufacturer for the above-mentioned rings or other page clasps. Rings and/or page clasps may optionally be bundled with such pre-punched covers for retail sale. Rings are preferred, since they allow the pages to lie flat when opened.

FIGS. 8–12 show a second embodiment, using only three scores and no adhesive. The spine is indented in a "v" shape, serving also as the tab for binder attachment. This inward fold hides the binding in the front and back views. The spine material should be stiff enough to retain this "v" shape, but flexible enough to hinge at the scores. Cover-weight paper serves this purpose. Once assembled, the comb tends to hold the "v" inward as desired. This embodiment has an improved appearance over existing comb and spiral ring binders.

FIGS. 14 and 15 show optional separate front panels in two configurations. The rear panel can likewise be separate if desired. This feature allows the user to copy labelling onto these panels using an office copy machine before assembling the cover, assuming the cover material is acceptable to the copier.

A generic version provides scores for different configurations, the selection of which is made by the user's choice of folding. The generic version is the same as FIG. 1, with the specification that two of the adjacent narrow panels 5 each have ½ the width of the third narrow panel 5. This allows folding and assembly of the preferred embodiment as in FIGS. 1–7, or folding and assembly per the second embodiment of FIGS. 8–12. The second embodiment uses only 3 of the 4 scores, and the user does not exposure the adhesive. The protective tape on the adhesive should be the same color as the cover material, since it is visible from the spine view when the second embodiment is produced from the generic version.

Other scoring and folding configurations are possible. For example, FIG. 16 shows the inwardly folded tab projecting from mid spine, rather than diagonally from the intersection of the spine and back and/or front panels. In this configuration, 5 scores are required on the spine portion, to define 4 narrow sub-panels, the inner two of which fold together to become the tab. Additional scores on the spine can allow the spine to curve with the rings if desired.

OPERATION OF PREFERRED EMBODIMENT

In the preferred mode of use, the user exposes the adhesive as in FIG. 2, and folds the cover material along an adjacent score as shown in FIGS. 3–4. Binding holes are punched in the folded edge of the cover as in FIG. 4, per normal use of a binder punch/installer. Matching holes are punched in the left edge of the document pages to be bound. The pages are placed face-up on the inner surface of the back panel, with all holes aligned. Binding rings are inserted through the holes per normal use of a binder installation station. The front panel is then rotated 360 degrees, away from the back panel, around the binding, to the front, creating hinges along the remaining scores in the process.

The above punching operations can be combined if the punch can handle the combined thickness of the pages and the folded cover. After the first fold of FIG. 3, the document pages are placed face-up on the inner surface of the back panel, with the left edge of the pages aligned with the folded edge of the cover. This aligned edge of the combined stack is punched, then moved to the ring installation station. Automation of this is possible for production of manuals and the like. The only remaining operation is rotation of the front panel, as above.

SCOPE

Specifics in the description and drawings exemplify preferred embodiments of the invention, but should not limit its scope, which is defined by the claims and their legal equivalents. Except as specifically recited in the claims, the elements can be of different sizes, and shapes, and of various materials.

I claim:

1. A document cover comprising:

a flat sheet of semi-flexible cover material having a plurality of parallel scores, folded along said scores to form a front panel, a spine, an inward-folded tab, and a back panel;

the inward-folded tab for attachment of page binding rings comprising two adjacent narrow panels, defined in the sheet by three of said scores, folded inward against each other and bonded together to form a single tab;

whereby a document cover is assembled by folding a sheet of cover material along scores, folding and bonding two adjacent sub-panels together to form an inward-folded tab, and attaching page binding rings thereto, resulting in a document cover with the binding rings hidden from external view.

2. The binder of claim 1, wherein the inwardly folded tab is formed from two adjacent narrow panels, defined in the sheet by three of said scores between the spine and back panel, folded inward and bonded to each other to form a single tab projecting diagonally inward from the intersection of the spine and the back panel.

3. The binder of claim 2, further comprising a second inwardly folded tab formed from two adjacent narrow panels, defined in the sheet by three of said scores between the spine and front panel, folded inward and bonded to each other to form a single tab projecting diagonally inward from the intersection of the spine and the front panel.

4. The binder of claim 1, wherein the spine comprises four narrow panels in sequence, defined in the sheet by five of said scores, including two central and two outer panels, and the inward-folded tab is formed from the two central panels folded inward and bonded to each other to form a single tab extending inward from the spine.

5. A document binder and cover, comprising:

a flat sheet of semi-flexible cover material;

a plurality of parallel scores in the cover material, segmenting it into a sequence of panels;

the cover material folded along said scores to form a generally U-shaped cross section with a front panel, a back panel, and a spine therebetween;

an inwardly folded tab of the cover material, formed by folding two adjacent said panels inward against each other, and bonding them together to form a single tab; and means for attaching multiple pages to said tab;

whereby said page attachment means is hidden in both the front and back view of the closed cover.

6. The binder of claim 5, wherein two adjacent narrow panels of equal width are defined between the spine and the back cover by three of said scores, and are folded inward against each other and bonded together to form the inwardly folded tab.

7. The binder of claim 5, wherein two adjacent narrow panels of equal width are defined between the spine and the front cover by three of said scores, and are folded inward against each other and bonded together to form the inwardly folded tab.

8. The binder of claim 5, wherein two adjacent narrow panels of equal width are defined in the spine by three of said scores, and are folded inward against each other and bonded together to form the inwardly folded tab.

9. A method for assembling a document cover with hidden binding, comprising the steps of:

a) folding a sheet of semi-flexible document cover material along parallel scores into a front panel, a spine, an inward-folded tab of two sub-panels, and a back panel;

b) bonding the two sub-panels of the inward folded tab together;

c) punching a single row of apertures in the inward-folded tab; and d) attaching page binding rings to the inward-folded tab through the apertures therein.

* * * * *